US005393136A

United States Patent [19]

Grabowski et al.

[11] Patent Number: 5,393,136

[45] Date of Patent: Feb. 28, 1995

[54] DRAWER WITH CONVERTIBLE FILING SUPPORT SYSTEM

[75] Inventors: Daniel Grabowski, Grand Rapids; John Van Kammen, Belmont, both of Mich.

[73] Assignee: Steelcase Inc., Grand Rapids, Mich.

[21] Appl. No.: 66,761

[22] Filed: May 25, 1993

[51] Int. Cl.[6] ..... A47B 63/02; B42F 15/00

[52] U.S. Cl. ..... 312/184; 312/193; 312/348.5; 211/162; 211/175

[58] Field of Search ..... 312/183, 184, 193, 348.5; 211/162, 175, 183

[56] References Cited

U.S. PATENT DOCUMENTS 5,255,798 10/1993 Aaldenberg et al. ..... 312/184

FOREIGN PATENT DOCUMENTS 1410728 8/1965 France ..... 312/184
0691178 5/1953 United Kingdom ..... 312/184
1347129 6/1975 United Kingdom ..... 312/184

*Primary Examiner*—Edward K. Look

*Assistant Examiner*—Christopher Verdier

*Attorney, Agent, or Firm*—Price, Heneveld, Cooper, DeWitt & Litton

[57] ABSTRACT

A suspension folder filing system includes a drawer having a width dimensioned for one size of suspension folder and a pair of elongated file suspension rails or supports. The suspension rails each include a downwardly opening channel having a base and spaced, generally parallel sidewalls adapted to receive and grip elongated sides of the drawer. Each rail includes first and second, laterally spaced, vertically extending file suspension ribs. The supports may be reversibly positioned on the sides of the drawer. When in a first position, the first ribs are positioned to receive the suspension hooks or rods of one size suspension folder. When in a reversed, second position, the second ribs are positioned with respect to each other on the drawer to receive a second, smaller size suspension folder. One or more side-to-side rails are mountable between the elongated suspension rails. The side-to-side rails and suspension rails provide a filing system which accommodates a plurality of different sizes of suspension folders.

28 Claims, 3 Drawing Sheets

DRAWER WITH CONVERTIBLE FILING SUPPORT SYSTEM

BACKGROUND OF THE INVENTION

The present invention relates to file storage systems and, more particularly, to a unique file suspension system adapted to support different size suspension or hanging folders.

Suspension or hanging-type file folders are in widespread use. Such folders are generally V-shaped in side elevation and include front and back panels Joined along an integral fold or hinge line. Suspension rods or hangers are joined to upper edges of the panels. The rods hook over or engage sides of a file drawer or cabinet. The folders form a pocket which will receive documents up to a maximum size determined by the depth of the folder and the length of the folder or the width of the drawer.

Metal filing cabinets or drawers are readily provided with configured upper side edges dimensioned to accommodate the hanger rods of such suspension folders. Currently available filing drawers may also include side-to-side hangers or rails which extend between the sides of the drawer. Available systems will accommodate a given size of suspension file in a front-to-back relationship or in a side-to-side relationship. Wood drawers require separate support rails, brackets or removable frames to accommodate suspension files or folders.

Examples of prior storage systems adapted to accommodate suspension folders may be found in U.S. Pat. No. 3,456,994 entitled FILE FOLDER SUSPENSION FOR DRAWERS, which issued on Jul. 22, 1969 to Sullivan; U.S. Pat. No. 3,748,008 entitled STORAGE CABINET, which issued on Jul. 24, 1973 to Pryor; U.S. Pat. No. 4,234,238 entitled FILE SUPPORT STRUCTURE FOR DRAWER, which issued on Nov. 18, 1980 to Figueroa; and U.S. Pat. No. 4,526,277 entitled HANGING FOLDER FRAME SUPPORT, which issued on Jul. 2, 1985 to Snowden et al. The hanging folder frame support disclosed in Snowden may be inverted to accommodate two different size hanging or suspension folders.

Currently available file drawers and file suspension systems will not accommodate the many different standard sizes of paper and suspension folders which might be encountered in the world market. In the United States, for example, paper sizes and suspension folders are standardized around letter size paper and legal size paper. In Europe, larger paper sizes, referred to as European A4 and foolscap, correspond to the letter and legal sizes employed in the United States. A drawer and suspension system dimensioned to accommodate letter size paper will not accommodate European A4 paper, for example, in a front-to-back relationship. In addition, Pacific Basin papers are still of another standardized dimension or size. Available systems accommodate the U.S., European or Pacific Basin standards but not all standards. It is currently common to provide a standard size drawer which will accommodate letter size files in a front-to-back orientation. Legal size files may be positioned in the drawer using side-to-side suspension rails and positioning the legal size papers in a side-to-side orientation. A need exists, however, for a filing system which will readily accommodate the various standard sizes of papers and suspension files currently encountered in the world market.

SUMMARY OF THE INVENTION

In accordance with the present invention, a suspension folder support or side rail is provided which is usable with a drawer to accommodate different size suspension folders within the same drawer. The suspension folder support includes an elongated, downwardly opening channel-shaped portion adapted to grippingly receive a side of the drawer. First and second, generally vertically extending ribs are also provided. The ribs are oriented with respect to the downwardly opening channel and each other so that, when the supports are positioned in a first orientation with respect to each other on the drawer sides, they accommodate one size of suspension folder and, when reversed and positioned in a second orientation with respect to each other, they accommodate a different, smaller size folder within the same drawer.

In narrower aspects of the invention, side-to-side support rails and mounting structure are provided which may be used in combination with the suspension folder supports. The side-to-side support rails and suspension folder supports permit a drawer to accommodate different size folders in front-to-back and side-to-side orientations. Using the components of the present system, a drawer dimensioned to accommodate European A4 size folders, for example, in a front-to-back relationship will also accommodate U.S. letter sized folders in a front-to-back relationship, U.S. legal size in a side-to-side relationship and European foolscap in a side-to-side relationship. In addition, a drawer dimensioned to accommodate European foolscap size paper in a front-to-back relationship will also accommodate U.S. legal size in a front-to-back relationship, as well as other combinations of suspension folders.

The present invention provides a versatile filing system which accommodates the many different standard sizes of paper and suspension folders which may be encountered in the marketplace. The system is readily adapted for sale as a kit. The system eliminates acquisition problems encountered by purchasing managers who, for various reasons, heretofore have previously chosen standard sizes which would not accommodate the sizes which might be encountered.

DETAILED DESCRIPTION OF THE PREFERRED EMBODIMENT

Figure 1:
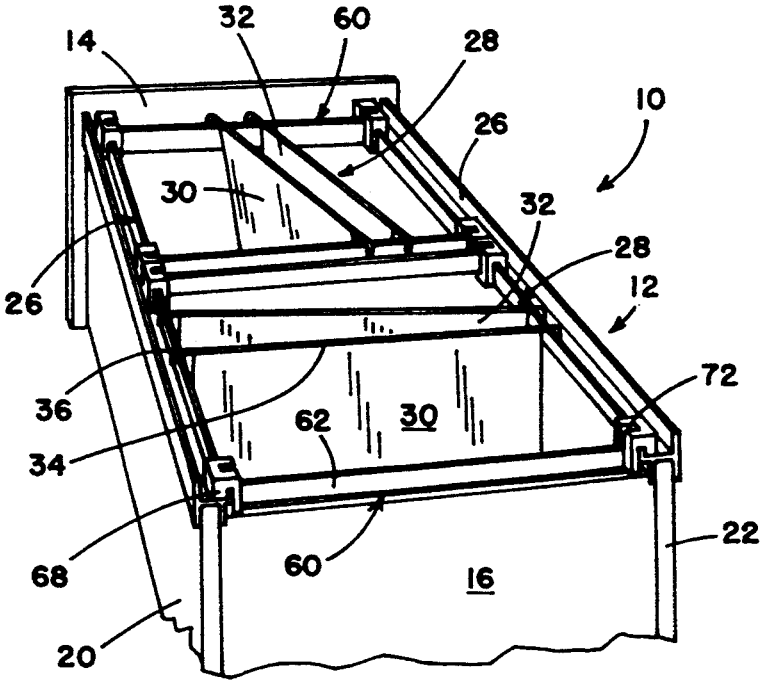
FIG. 1 is a fragmentary, perspective view of a drawer and filing system in accordance with the present invention.

A drawer and suspension folder or article of furniture in accordance with the present invention is illustrated in FIG. 1 and generally designated by the numeral 10. System 10 includes a drawer generally designated 12. Drawer 12 is made from wood and includes a front vertical panel 14, a rear vertical panel 16, a bottom 18 (FIG. 5) and spaced sides 20, 22. Elongated drawer rails or suspension folder supports 26 are positioned on and extend along upper edges of sides 20, 22. As discussed in more detail below, rails 26 are adapted to suspend hanger folders 28. Folders 28 each include front and back panels 30, 32. Hanger rods 34 are joined to the upper edges of panels 30, 32. The hanger rods 34 include end hook portions 36 which engage supports 26.

Figure 2:
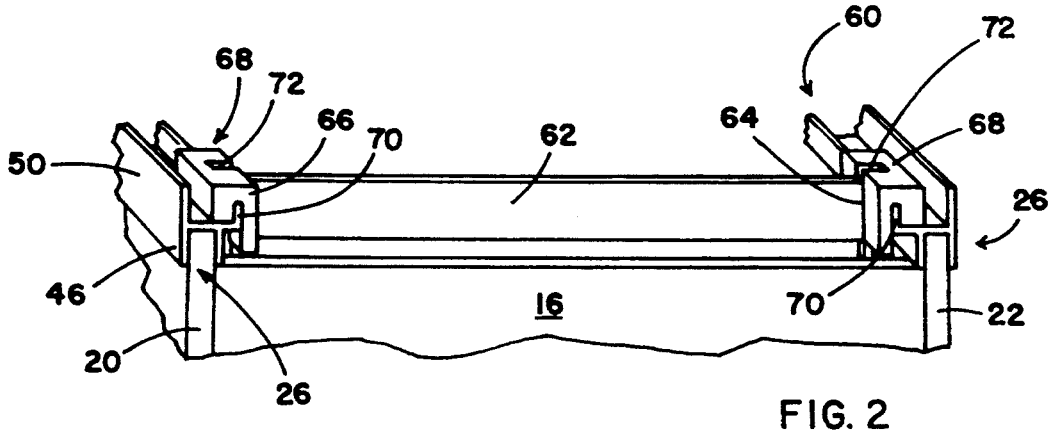
FIG. 2 is an enlarged, fragmentary, rear perspective view of a portion of the filing cabinet and system of FIG. 1.
Figure 3:
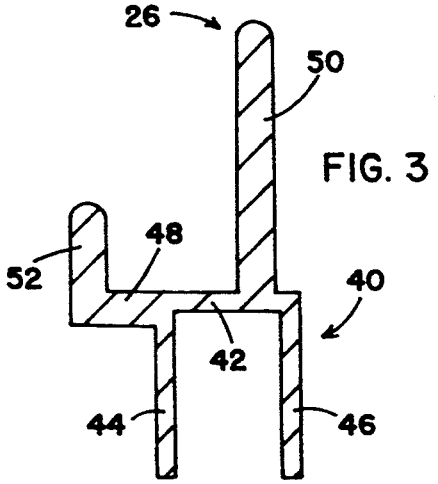
FIG. 3 is an end, elevational view of one form of suspension folder support or rail in accordance with the present invention.

As best seen in FIG. 3, each support 26 is preferably formed as an integral extrusion. Support 26 includes a mounting structure or downwardly opening channel portion 40. Channel portion 40 includes a base 42 and elongated, vertical sides 44, 46. The spacing or width between sides 44, 46 is dimensioned, as seen in FIG. 2, to receive and grip the upper elongated portion of sides 20, 22 of the drawer. Channel portion 40 mounts support 26 on the drawer sides. Base 42 includes an integral extension 48 which extends beyond the vertical plane within which side 44 lies. Base 42, including extension 48, has a width greater than the width of channel portion 40. A first, generally vertical rib 50 extends from base 42 in a plane which is offset but substantially the same plane within which side 46 lies. In the preferred form illustrated in FIG. 3, rib 50 is spaced inwardly slightly from the plane of side 46. The second rib 52 extends from a lateral outer edge of base portion 48. First rib 50 has a height dimension with respect to base 42 which is greater than the height dimension of rib 52. Ribs 50, 52 and base 42 define an upwardly opening channel having a width greater than the width of channel portion 40. Supports 26 are reversibly positionable on the side of drawer 12.

Figure 4:
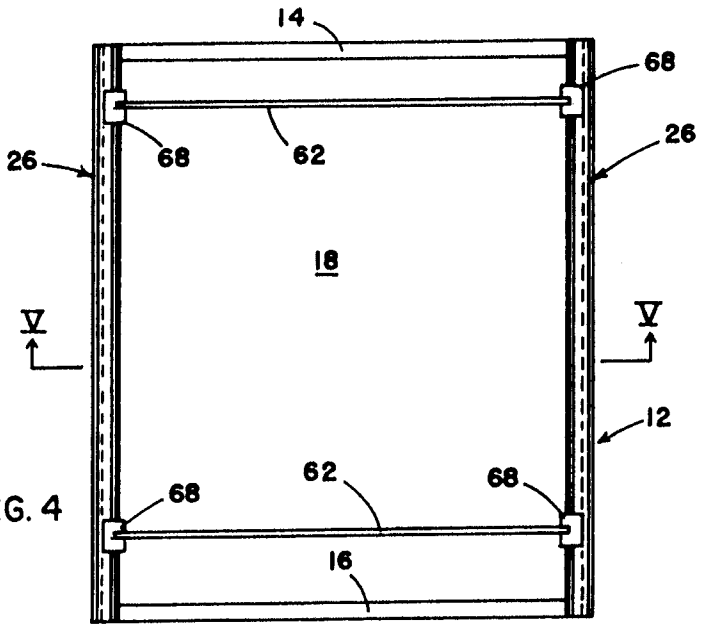
FIG. 4 is a top, plan view of a drawer or suspension system in accordance with the present invention.

In addition, the filing system in accordance with the present invention may include one or more side-to-side support rail assemblies generally designated 60. The side-to-side assemblies include an elongated rail or bar-like member 62. Ends 64, 66 of rail 62 are received within support blocks 68. As seen in FIGS. 1, 2 and 4, support blocks 68 define a downwardly opening slot or groove 70 dimensioned to receive rib 50 or rib 52 of support 26. An inwardly directed slot 72 defined by block 68 is adapted to receive an end 64, 66 of rail 62. The blocks, therefore, mount the rail in a side-to-side orientation between sides 20, 22 of the drawer. The blocks may be slid or positioned along the support rails to position the bar 62.

As shown in FIG. 1, a pair of side-to-side rail assemblies 60 may be mounted on the supports 26. Hanger or suspension folders 30 may then be positioned in a side-to-side relationship wherein their length dimensions are parallel to the sides of the drawer. The combination of side-to-side rail assemblies and side supports permits the drawer to accommodate different size suspension folders 30 in front-to-back orientations and side-to-side orientations.

Figure 5:
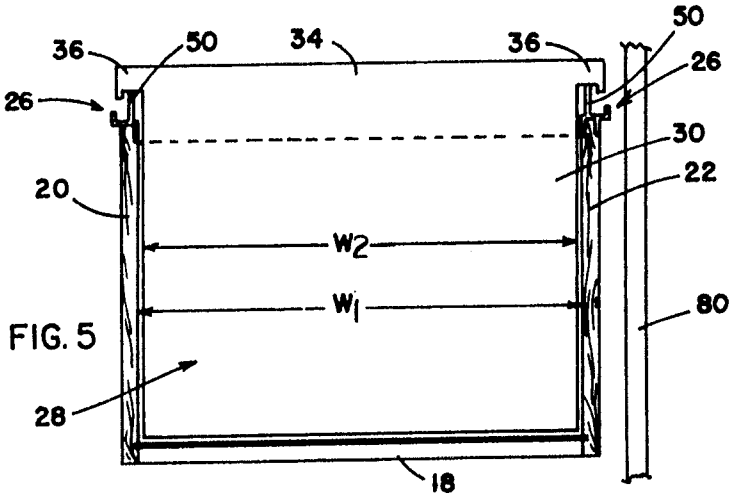
FIG. 5 is a cross-sectional view of the system of FIG. 4 taken generally along lines V—V.

In the embodiment illustrated in FIGS. 4 and 5, the drawer 12 has the width dimension $W_1$ between the inner opposed faces of sides 20, 22 dimensioned to accommodate a hanging folder 28 having a length dimension $W_2$. It is presently preferred that dimension $W_1$ in this embodiment be 318.0 mm to accommodate the width or length of an A4 folder. The depth of the drawer 12 from bottom 18 to the upper edges of the sides and the height of first rib 50 are dimensioned to accommodate the depth of an A4 folder.

Figure 6:
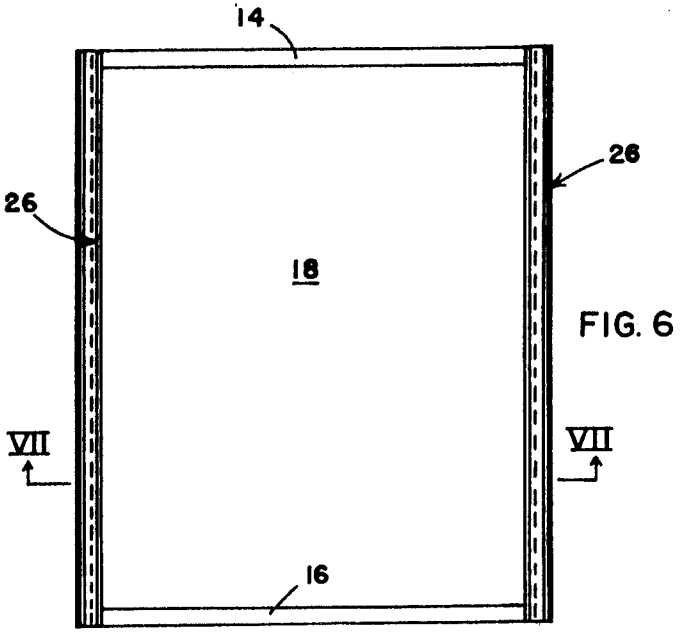
FIG. 6 is a top, plan view of a drawer and filing system in accordance with the present invention with the side support rails in a second orientation.
Figure 7:
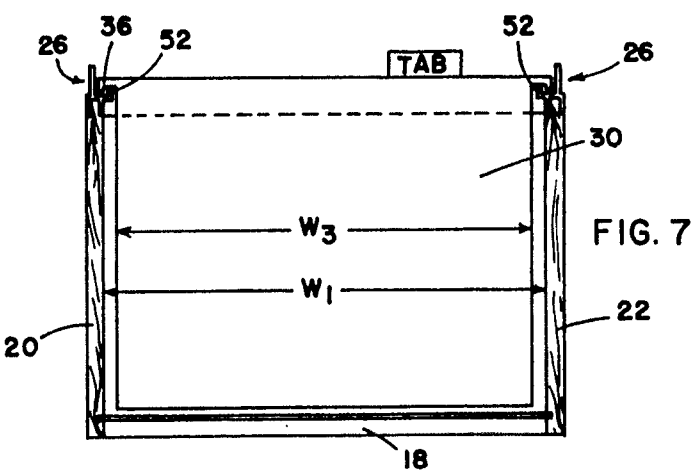
FIG. 7 is a cross-sectional view taken generally along line VII—VII of FIG. 6.

As illustrated in FIG. 5, the suspension rod or hooks 36 rest on and engage the vertical flange or rib 50 when supports 26 are in a first orientation with ribs 50 in an opposed, facing relationship. Supports 26, as seen in FIGS. 6 and 7, may be reversed in position to a second orientation wherein ribs 52 are in opposed, facing relationship. When in this position, the supports are adapted to suspend a letter size hanging folder 30. Vertical ribs 52 are positioned closer to each other to accommodate the width or length $W_3$ of the alternative folder 28. As schematically illustrated in FIG. 5, the system is designed for use in a cabinet or pedestal including a side panel 80. The side panels of the pedestal are spaced a sufficient distance to accommodate the outward extension and positioning of ribs 52 when supports 26 are in the orientation illustrated in FIG. 5.

It is presently preferred that drawer 12 be provided in two different sizes. In each size, the width of the drawer is set at $W_1$, as illustrated in FIG. 5, to accommodate European A4 suspension folders. In the first form, the drawer has a length of 16 inches. This configuration in conjunction with supports 26 and side-to-side rail assemblies 60 would accommodate letter size folders in a front-to-back orientation and in a side-to-side orientation. European A4 size folders would be accommodated in a front-to-back orientation and also in a side-to-side orientation. U.S. legal size paper and European foolscap would be accommodated on the side-to-side rails in a side-to-side orientation. The length or distance between the front and back panels 14, 16 is selected at 16 inches to accommodate foolscap paper length and folder dimension.

In the second size, the drawer has a width $W_1$ and a length between the front and back panels 14, 16 equal to approximately 26 inches. Such an arrangement will accommodate letter size suspension folders on a front-to-back relationship or in combination with the side-to-side rail assemblies two deep or in two rows in a side-to-side relationship. European A4 paper would be accommodated in a front-to-back relationship or in a single row in a side-to-side relationship. Again, legal and foolscap would be accommodated in a single row in a side-to-side relationship.

Figure 8:
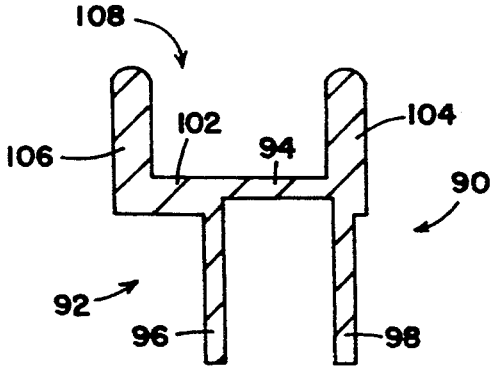
FIG. 8 is an end elevational view of another form of suspension folder support or rail in accordance with the present invention.
Figure 9:
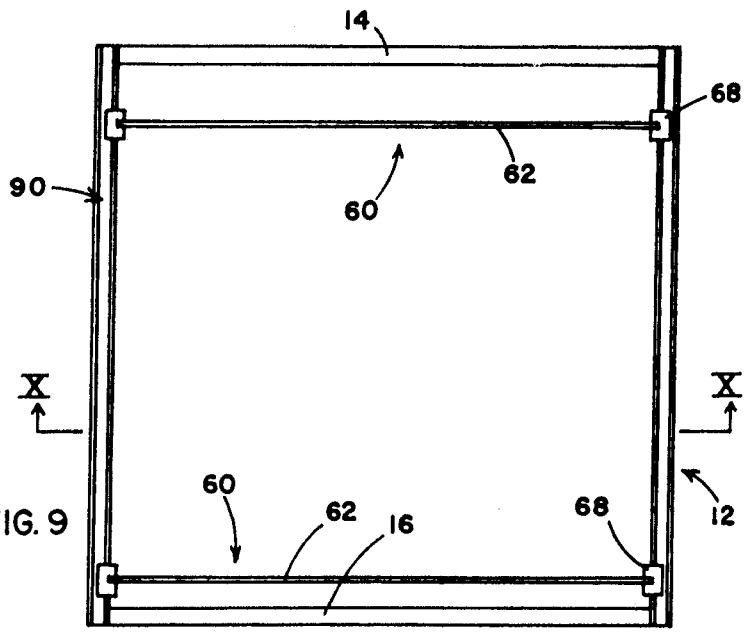
FIG. 9 is a top, plan view of a drawer and filing system in accordance with another embodiment of the present invention.
Figure 10:
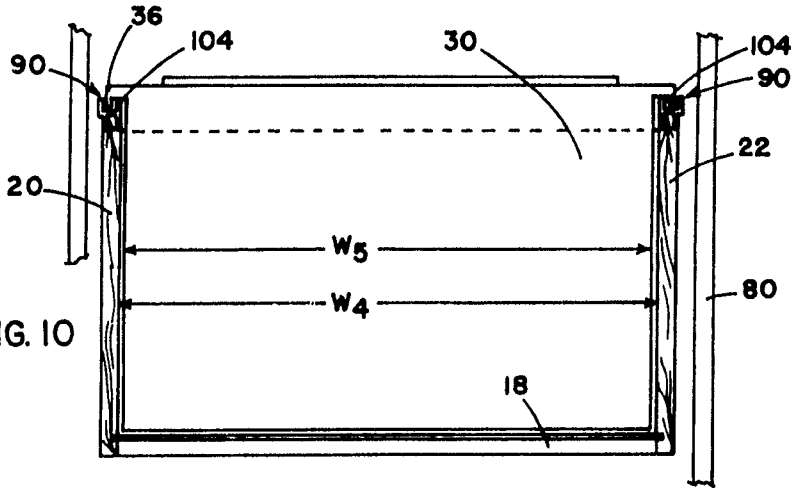
FIG. 10 is a cross-sectional view of the system of FIG. 9 taken generally along line X—X.

A support or drawer rail in accordance with another embodiment of the present invention is illustrated in FIG. 8 and generally designated by the numeral 90. Rail 90 includes a downwardly opening channel portion 92 defined by a base 94 and spaced, generally parallel sides 96, 98. As seen in FIGS. 9 and 10, portion 92 is configured to receive and mount support 90 on sides 20, 22 of drawer 12. Base 94 includes a portion 102 extending horizontally past side 96. A first rib 104 extends from base 94 opposite side 98. Rib 104 lies in a plane which is in substantially the same plane as side 98. A second rib 106 extends from base 94 in another plane which was laterally spaced away from side 96 and first rib 104. Ribs 104, 106 are of the same height and define an upwardly opening channel 108. Support 90 is adapted to accommodate foolscap folders and legal size folders as illustrated in FIGS. 9–12.

Figure 11:
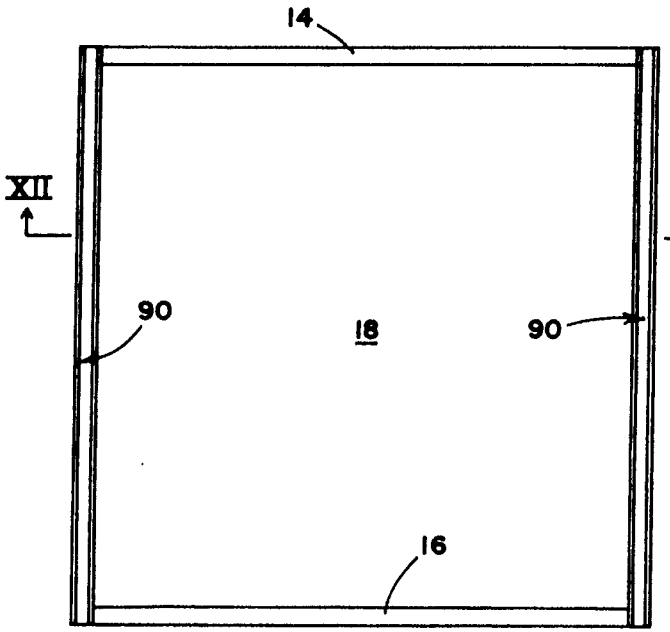
FIG. 11 is a top, plan view of the drawer and system in accordance with the another embodiment with the side support rails in a second orientation.
Figure 12:
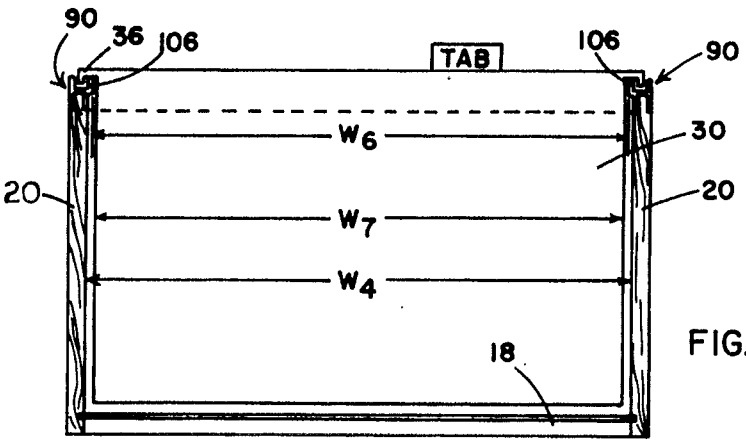
FIG. 12 is a cross-sectional view taken generally along line XII—XII of FIG. 11.

The drawer illustrated in FIGS. 9–12 includes an inner width $W_4$ between sides 20, 22 adapted to accommodate the width $W_5$ of foolscap suspension folders. Foolscap folders 30 engage ribs 104 of supports 90 when such are positioned in their first orientation relative to each other. When supports 90 are reversed in orientation, as illustrated in FIGS. 11 and 12, ribs 106 are presented in opposed relationship. The ribs define a width dimension $W_6$ which is adapted to accommodate a suspension folder 28 having a width $W_7$ equivalent to U.S. legal size folders. Since foolscap and U.S. legal size suspension folders have the same depth, ribs 104, 106 may be of the same height.

The drawer assembly illustrated in FIGS. 9 and 10, including supports 90, would replace a currently standard U.S. legal size drawer in a desk, file cabinet or the like. The drawer has a foolscap width and may be provided with a depth or length between front 14 and rear 16 equal to the foolscap file length or equal to a double letter length. The drawer, supports 90 and side-to-side rail assemblies 60 will, therefore, accommodate letter, A4, legal and foolscap in side-to-side and front-to-back variations similar to the system of FIGS. 4–7. In the drawer having a foolscap width and foolscap depth, letter size folders could be accommodated in a side-to-side arrangement, and A4 would be accommodated in a side-to-side arrangement. Legal size would be accommodated in a side-to-side or front-to-back arrangement using the support rail assemblies 60. Foolscap would be accommodated in both side-to-side and front-to-back orientations.

With a drawer provided in a foolscap width and double letter depth or length dimension between the front and back panels, two rows of letter size folders could be accommodated in a side-to-side relationship. A single row of A4 folders could be accommodated in a side-to-side relationship. Legal size folders could be accommodated in both a front-to-back relationship using the supports 90 and in a side-to-side relationship using rail assembly 60. Foolscap could be accommodated similarly in a front-to-side relationship with rails 90 and in a side-to-side relationship using side-to-side rails 60.

The overall system standardizes drawer sizes to accommodate presently encountered standard suspension or hanging folder sizes, such as U.S. letter and legal and European A4 and foolscap. The system provides multiple orientations for the various media types. The system, including at least a pair of first supports 90 and second supports 26, is readily sold in kit form so that the purchaser may accommodate the drawer to the particular type of media most likely encountered or hanging folders of different depth dimensions. All media which are reasonably expected to be encountered could also be accommodated. The system is readily adaptable to wood drawers. Difficulties encountered with assembling and using frame systems heretofore provided are eliminated. The system is versatile and readily usable in the field.

In view of the above description, those of ordinary skill in the art may envision various modifications which would not depart from the inventive concepts disclosed herein. The above description should, therefore, be considered as only that of the preferred embodiment. The true spirit and scope of the present invention may be determined by reference to the appended claims.

The embodiments of the invention in which an exclusive property or privilege is claimed are defined as follows:

1. A suspension folder support for use with the sides of a drawer and adapted to suspend different size folders within the same drawer, said support comprising:

an elongated downwardly opening channel-shaped portion having spaced, generally parallel sides and a base, said channel-shaped portion dimensioned to receive one of the sides of the drawer;

a first rib extending vertically from said base generally in the same plane as one of said sides of said channel-shaped portion;

a second rib extending from said base generally in a plane which is laterally offset from the other of said sides of said channel-shaped portion and away from said first rib, said ribs thereby defining an upwardly opening channel having a width greater than the width of said downwardly opening channel, said support being reversibly positionable on the side of the drawer so that when a pair of said supports are positioned on the sides of the drawer in one orientation a folder of first width may be suspended from said first ribs and when the supports are reversed a folder having a second, greater width may be suspended from said second ribs.

2. A suspension folder support as defined by claim 1 wherein said base has a width greater than the width of said downwardly opening channel.

3. A suspension folder support as defined by claim 2 wherein said first and second ribs extend in spaced, generally parallel relationship.

4. A suspension folder support as defined by claim 1 wherein said first rib has a height dimension from said base greater than the height dimension of said second rib so that said support can suspend folders having different depth dimensions.

5. A suspension folder support as defined by claim 4 wherein said first rib is dimensioned to suspend at least one of said folders which is dimensioned for European A4 size paper.

6. A suspension folder support as defined by claim 5 wherein said second rib is dimensioned to suspend at least one of said folders which is [a folder]dimensioned for U.S. letter size paper.

7. A suspension folder support as defined by claim 6 wherein said base has a width greater than the width of said downwardly opening channel.

8. A suspension folder support as defined by claim 7 wherein said first and second ribs extend in spaced, generally parallel relationship.

9. A file suspension kit adapted for use in suspending a plurality of different size hanging folders from drawers having a front, a back, a bottom and spaced, parallel sides, said kit comprising:

at least a pair of first supports, said first supports each including an elongated downwardly opening channel having a base and spaced sides dimensioned to receive one of the sides of the drawer, a first rib and a second rib, said ribs extending from said base in spaced, generally parallel relationship to define an upwardly opening channel having a width greater than the width of said downwardly opening channel so that said first rib extends in substantially the same plane as one of said downwardly opening channel sides and said second rib extends in a plane laterally offset from the other of said downwardly opening channel sides; and at least a pair of second supports, said second supports each including an elongated downwardly opening channel having a base and spaced sides dimensioned to receive one of the sides of the drawer, a first rib and a second rib, said ribs extending from said base in spaced, generally parallel relationship to define an upwardly opening channel having a width greater than the width of said downwardly opening channel so that said first rib extends in the same plane as one of said downwardly opening channel sides and said second rib extends in a plane laterally offset from the other of said downwardly opening channel sides; and wherein said first rib has a height dimension from said base, greater than the height dimension of said second rib so that said second supports can suspend hanging folders having different depth dimensions.

10. A file suspension kit as defined by claim 9 further comprising:

at least one side-to-side rail dimensioned to extend between sides of the drawer; and side-to-side rail mounting means engaging said side-to-side rail for mounting said side-to-side rail to one of said first and second pairs of supports and thereby permitting folders to be hung in a front-to-back relationship and in a side-to-side relationship.

11. A file suspension kit as defined by claim 10 wherein said first and second ribs of each support of said pair of first supports are of the same height and said first supports are adapted to suspend foolscap and U.S. legal size folders.

12. A file suspension kit as defined by claim 9 wherein said first rib and second ribs of each support of said pair of first supports are of different height with said first rib having a height greater than said second rib so that said first supports are adapted to hang European A4 and U.S. letter size folders.

13. A file suspension kit as defined by claim 12 further comprising:

at least one side-to-side rail dimensioned to extend between sides of a drawer; and side-to-side rail mounting means engaging said side-to-side rail for mounting said side-to-side rail to one of said pairs of first and second supports and thereby permitting folders to be hung in a front-to-back relationship and in a side-to-side relationship.

14. A file suspension kit as defined by claim 13 wherein said base of each of said first and second supports has a width greater than the width dimension of said downwardly opening channel of each of said first and second supports.

15. A file suspension kit as defined by claim 14 wherein said mounting means comprises a pair of blocks, each block defining a slot to receive an end of said side-to-side rail.

16. An assembly for suspending different size suspension folders, comprising:

a drawer having a front, a back, a bottom and spaced, parallel sides extending between said front and back; and a pair of elongated side rails, each rail including means for reversibly mounting said rail on one of said drawer sides and elongated first and second ribs joined to said mounting means, said rails dimensioned and said ribs positioned so that said first rib extends in a first vertical plane a first predetermined distance from an opposite drawer side to accommodate a folder having one width dimension when the rail is in a first orientation on one drawer side, and said second rib extends in a second vertical plane a second predetermined distance from the opposite drawer side to accommodate a folder having another width dimension when the rail is in a second, reversed orientation on the one drawer side.

17. An assembly as defined by claim 16 wherein said drawer is dimensioned to accommodate European A4 size folders and said first rib of each rail has a height dimension greater than the height dimension of said second rib to accommodate the depth of A4 size folders.

18. An assembly as defined by claim 16 further including a side-to-side support extending between said side rails.

19. An assembly as defined by claim 17 wherein said means for reversibly mounting comprises:

a downwardly opening channel portion having a channel base integral with said ribs and spaced, parallel channel sides dimensioned to receive and grip a drawer side.

20. An assembly as defined by claim 19 further including side-to-side support extending between said side rails.

21. An assembly as defined by claim 18 wherein said drawer has a width dimension to accommodate foolscap folders and said first and second ribs are of the same vertical height.

22. An assembly as defined by claim 21 further including a side-to-side support extending between said side rails.

23. A reversible drawer rail, comprising:

an elongated gripping member portion having a generally inverted U-shaped cross section formed by a first side, top and second side sections, said portion being adapted to frictionally engage the top edge of a vertical drawer panel and further being adapted to reversibly engage said top edge of said vertical drawer panel; and a pair of elongated ribs projecting upwardly away from said portion, the outer edge of each said rib being adapted to engage and support a hanging file folder, a first rib of said pair of ribs being aligned generally parallel to the first side of said portion so as to position the outer edge of said first rib at a known distance relative to the first side of said portion, a second rib of said pair of ribs being aligned generally parallel to the second side of said portion so as to position the outer edge of said second rib at a known distance relative to the second side of said portion, the alignment of said outer edge of said second rib relative to said second side being different from the alignment of said outer edge of said first rib relative to said first side so that said drawer rail may be reversed on said drawer panel to accommodate differently sized hanging file folders.

24. An article of furniture, comprising:

a drawer having a substantially horizontal bottom panel and four substantially vertical side panels arranged to form a drawer compartment having a top opening;

a pair of drawer rails disposed on a respective pair of opposed side panels, each of said drawer rails having an elongated gripping member portion having a generally U-shaped cross section formed by a first side, a top and second side sections, said gripping member portion being adapted to frictionally and reversibly engage a top edge of one of the vertical side panels, each of said drawer rails further having a pair of elongated ribs terminating in respective outer edges, the outer edge of each said rib being adapted to engage and support a hanging file folder;

the first rib of said pair of ribs of each said rails being aligned generally parallel to and at a known distance relative to the first side of said gripping member portion, said alignment being such that, when said rails are placed on said opposed vertical side panels with said first sides facing each other, a first hanging file folder can engage the outer edge of said first ribs and be supported in said drawer; and the second rib of said pair of ribs of each said rail being aligned generally parallel to and at a known distance relative to the second side of each said gripping member portion, said alignment being such that, when said rails are placed on said opposed vertical side panels with said second sides facing each other, a second hanging file folder can engage the outer edge of said second ribs and be supported in said drawer, said second folder being of a size different than said first folder.

25. A suspension folder support for use with a drawer, said support comprising:

a pair of elongated side rails, each side rail including means for reversibly mounting said rail on a side of the drawer and elongated first and second ribs joined to said mounting means, said rails dimensioned and said ribs positioned so that said first rib extends in a first vertical plane a first predetermined distance from an opposite side of the drawer to accommodate a folder having one width dimension when the rail is in a first orientation on one drawer side, and said second rib extends in a second vertical plane a second predetermined distance from the opposite side of the drawer to accommodate a folder having another width dimension when the rail is in a second, reversed orientation on the one drawer side.

26. A support as defined by claim 25 wherein said first rib of each rail has a height dimension greater than the height dimension of said second rib to accommodate the depth of A4 size folders.

27. A support as defined by claim 25 wherein said means for reversibly mounting comprises:

a downwardly opening channel portion having a channel base integral with said ribs and spaced, parallel channel sides dimensioned to receive and grip the side of the drawer.

28. A support as defined by claim 25 wherein said means for reversibly mounting said rail engages at least a portion of the side of the drawer.

* * * * *

UNITED STATES PATENT AND TRADEMARK OFFICE

CERTIFICATE OF CORRECTION

PATENT NO. : 5,393,136

DATED : February 28, 1995

INVENTOR(S) : Daniel Grabowski, et al

It is certified that error appears in the above-indentified patent and that said Letters Patent is hereby corrected as shown below:

Column 3, line 17, after "folder" insert --filing system--.

Column 5, line 52, "to-side" (first occurence) should be --to-back--.

Signed and Sealed this

Fifth Day of December, 1995

*Attest:*

*Attesting Officer*

BRUCE LEHMAN

*Commissioner of Patents and Trademarks*